United States Patent [19]

Widin

[11] Patent Number: 4,901,353

[45] Date of Patent: Feb. 13, 1990

[54] AUDITORY PROSTHESIS FITTING USING VECTORS

[75] Inventor: Gregory P. Widin, Township of West Lakeland, County of Washington, Minn.

[73] Assignee: Minnesota Mining and Manufacturing Company, St. Paul, Minn.

[21] Appl. No.: 192,351

[22] Filed: May 10, 1988

[51] Int. Cl.[4] ..... H04K 25/00

[52] U.S. Cl. ..... 381/68; 381/60; 381/68.2; 381/68.4

[58] Field of Search ..... 381/68, 68.2, 68.4, 381/60

[56] References Cited

U.S. PATENT DOCUMENTS

| | | | |
|---|---|---|---|
| 4,025,721 | 5/1977 | Graupe et al. | 381/68.2 |
| 4,185,168 | 1/1980 | Graupe et al. | 381/68 |
| 4,425,481 | 1/1984 | Mansgold et al. | 381/68.2 |
| 4,471,171 | 9/1984 | Köpke et al. | 381/68 |
| 4,508,940 | 4/1985 | Steeger | 381/68.2 |
| 4,548,082 | 10/1985 | Engebretsen et al. | 381/68.2 |
| 4,596,902 | 6/1986 | Gilman | 381/68.2 |
| 4,622,440 | 11/1986 | Slavin | 381/68 |
| 4,791,672 | 12/1988 | Nunley | 381/68 |

OTHER PUBLICATIONS

Skinner, Margaret W., Hearing Aid Evaluation, Prentice Hall, Englewood Cliffs, New Jersey (1988).

Briskey, Robert J., "Instrument Fitting Techniques", from Sandlin, Rober E., Hearing Instrument Science and Fitting Practices, National Institute for Hearing Instruments Studies, Livonia, Michigan, pp. 439–494 (1985).

Green, David S., "Pure Tone Air Conduction Testing", Chapter 9, in Katz, Jack, Editor, Handbook of Clinical Audiology, Williams & Wilkins, Baltimore, Maryland (1978).

Adby, P. R. and Dempster, M. A. H., Introduction to Optimization Methods, Chapman and Hall, London (1974).

*Primary Examiner*—Jin F. Ng
*Assistant Examiner*—Danita R. Byrd
*Attorney, Agent, or Firm*—Donald M. Sell; Walter N. Kirn; William D. Bauer

[57] ABSTRACT

Hearing improvement device, auditory prosthesis, hearing aid, fitting device for these apparatus and method of fitting or determining new auditory characteristic by selecting and applying a vector consisting of relative changes to a plurality of individual ones of a set of acoustic parameters which determine the auditory characteristic of such apparatus. The method involves selecting a proper vector, applying the relative changes to the individual acoustic characteristics and, if necessary, utilizing or storing these new values of acoustic characteristics to obtain a new auditory characteristic for such apparatus.

40 Claims, 5 Drawing Sheets

AUDITORY PROSTHESIS FITTING USING VECTORS

BACKGROUND OF THE INVENTION

The present invention relates generally to auditory prostheses and more particularly to auditory prostheses having adjustable acoustic parameters.

Auditory prostheses have been utilized to modify the auditory characteristics of sound received by a user or wearer of that auditory prosthesis. Usually the intent of the prosthesis is, at least partially, to compensate for a hearing impairment of the user or wearer. Hearing aids which provide an acoustic signal in the audible range to a wearer have been well known and are an example of an auditory prosthesis. More recently, cochlear implants which stimulate the auditory nerve with an electrical stimulus signal have been used to improve the hearing of a wearer. Other examples of auditory prostheses are implanted hearing aids which stimulate the auditory response of the wearer by a mechanical stimulation of the middle ear and prostheses which otherwise electromechanically stimulate the user.

Hearing impairments are quite variable from one individual to another individual. An auditory prosthesis which compensates for the hearing impairment of one individual may not be beneficial or may be disruptive to another individual. Thus, auditory prostheses must be adjustable to serve the needs of an individual user or patient.

The process by which an individual auditory prosthesis is adjusted to be of optimum benefit to the user or patient is typically called "fitting". Stated another way, the auditory prosthesis must be "fit" to the individual user of that auditory prosthesis in order to provide a maximum benefit to that user, or patient. The "fitting" of the auditory prosthesis provides the auditory prosthesis with the appropriate auditory characteristics to be of benefit to the user.

This fitting process involves measuring the auditory characteristics of the individual's hearing, calculating the nature of the acoustic characteristics, e.g., acoustic amplification in specified frequency bands, needed to compensate for the particular auditory deficiency measured, adjusting the auditory characteristics of the auditory prosthesis to enable the prosthesis to deliver the appropriate acoustic characteristic, e.g., acoustic amplification is specified frequency bands, and verifying that this particular auditory characteristic does compensate for the hearing deficiency found by operating the auditory prosthesis in conjunction with the individual. In practice with conventional hearing aids, the adjustment of the auditory characteristics is accomplished by selection of components during the manufacturing process, so called "custom" hearing aids, or by adjusting potentiometers available to the fitter, typically an otologist, audiologist, hearing aid dispenser, otolaryngologist or other doctor or medical specialist.

Some hearing aids are programmable in addition to being adjustable. Programmable hearing aids have some memory device in which is stored the acoustic parameters which the hearing aid can utilize to provide a particular auditory characteristic. The memory device may be changed or modified to provide a new or modified auditory parameter or set of acoustic parameters which in turn will provide the hearing aid with a modified auditory characteristic. Typically the memory device will be an electronic memory, such as a register or randomly addressable memory, but may also be other types of memory devices such as programmed cards, switch settings or other alterable mechanism having retention capability. An example of a programmable hearing aid which utilizes electronic memory is described in U.S. Pat. No. 4,425,481, Mangold. With a programmable hearing aid which utilizes electronic memory, a new auditory characteristic, or a new set of acoustic parameters, may be provided to the hearing aid by a host computer or other programming device which includes a mechanism for communicating with the hearing aid being programmed.

In order to achieve an acceptable fitting for an individual, changes or modifications in the acoustic parameters may need to be made, either initially to achieve an initial setting or value of the acoustic parameters or to revise such settings or values after the hearing aid has been used by the user. Known mechanisms for providing settings or values for the acoustic parameters usually involve measuring the hearing impairment of an individual and determining the setting or values necessary for an individual acoustic parameter in order to ameliorate the hearing impairment so measured. Such mechanisms operate well to obtain initial settings or values but do not operate well to obtain changes or modifications in such parameters to obtain a different auditory characteristic of the hearing aid.

SUMMARY OF THE INVENTION

The present invention solves these problems by providing a fitting adjustment mechanism which adjusts the auditory characteristic of the auditory prosthesis by providing relative changes in a plurality of individual ones of a set of acoustic parameters which specify an auditory characteristic. Instead of modifying the acoustic parameters individually and instead of redetermining the acoustic parameters ab initio, the vector is selected which selectively specifies relative changes to a plurality of acoustic parameters. Since relative changes are provided to the settings or values of the acoustic parameters, a relative change in the auditory characteristic of the auditory prosthesis may be obtained. By way of example, a vector which increases intelligibility in low noise environments provides relative changes in the values of individual acoustic parameters which may increase the gain provided to high frequency signals and which may raise the cutoff frequency between low and high frequency bands. Since the vector provides relative changes in a particular direction to achieve a particular improvement or change in the auditory characteristic, the vector may by applied multiple times or a combination of vectors may be applied to achieve a desired result. Typically the vector may be applied regardless of the values of the acoustic parameters specified in the original fitting. Further since many of the acoustic parameters may interact with each other, the use of a vector helps to eliminate repetitive, empirical readjusting of individual acoustic parameters to achieve a particular overall beneficial result.

The present invention is designed for use with a hearing improvement device having a storage mechanism for storing a set of signal processing parameters corresponding to a known signal processing characteristic, and a signal processor to process a signal representing sound in accordance with the set of signal processing parameters with at least one of the signal processing parameters designed to compensate for a hearing impairment, and provides a method of determining a new set of the signal processing parameters in accordance with a desired change in the auditory characteristics of the hearing improvement device. The first step is selecting a vector consisting of relative changes in the values of individual signal processing parameters in accordance with predetermined signal processing goals related to the desired change in the auditory characteristics of the hearing improvement device. The next step is applying the relative changes in the values of the individual signal processing parameters of the vector against the values of corresponding ones of the individual signal processing parameters to create a new set of signal processing parameters.

The present invention is also designed for use with an auditory prosthesis having a plurality of memories, each of the plurality of memories storing a set of signal processing parameters, at least one of the signal processing parameters designed to compensate for a hearing deficiency, each of the set of signal processing parameters corresponding to a known signal processing characteristic, a signal processor to process a signal representing sound in accordance with a selected one of the plurality of sets of signal processing parameters, and a selection mechanism coupled to the plurality of memories and to the signal processor for selecting one of the plurality of memories to determine which set of signal processing parameters is utilized by the signal processor, and provides a method of determining the values of a new set of signal processing parameters in accordance with a desired change in the auditory characteristics of the auditory prosthesis. The first step is selecting a vector which consists of relative changes in the values of individual signal processing parameters in accordance with predetermined signal processing characteristics related to the desired change in the auditory characteristics of the auditory prosthesis. The next step is applying the relative changes in the values of the individual signal processing parameters of the vector against the values of corresponding ones of the signal processing parameters of a known signal processing characteristic to create a new signal processing characteristic. The next step is utilizing the new signal processing characteristic in the signal processor of the auditory prosthesis.

The present invention is also designed for use with a hearing improvement device having a plurality of memories, each of the plurality of memories for storing a signal processing characteristic specifying a plurality of signal processing parameters at least one of which is designed to compensate for a hearing impairment, a signal processor to process a signal representing sound in accordance with a selected signal processing characteristic, and a memory selection mechanism coupled to the plurality of memories and to the signal processor for selecting one of the plurality of memories to determine which signal processing characteristic is utilized by the signal processor, and provides an apparatus for determining the values of the signal processing parameters for a particular signal processing characteristic from the values of the signal processing parameters of a known signal processing characteristic. A vector selection mechanism selects a vector consisting of relative changes in the values of individual signal processing parameters in accordance with predetermined signal processing characteristics. An application mechanism is coupled to the vector selection mechanism and applies the relative changes in the values of the individual signal processing parameters of the vector against the values of the signal processing parameters of a known signal processing characteristic to create a new signal processing characteristic. A storing mechanism is coupled to the application mechanism and stores the new signal processing characteristic in one of the plurality of memories.

The present invention also provides a hearing aid. The hearing aid has a microphone for converting acoustic information into an electrical input signal, a signal processor receiving the electrical input signal and operating on the electrical input signal in response to a set of signal processing parameters at least one of which is designed to compensate for a hearing impairment and producing a processed electrical signal, and a receiver coupled to the signal processor for converting the processed electrical signal to a signal adapted to be perceptible to a patient. The hearing aid also has a first storage mechanism operably coupled to the signal processor for storing at least one of the set of signal processing parameters. A vector mechanism is provided for storing a vector consisting of relative changes in the values of individual signal processing parameters in accordance with predetermined signal processing characteristics. Further, an application mechanism operably coupled to the first storage mechanism and the vector mechanism is provided for applying the relative changes in the values of the individual signal processing parameters of the vector against the values of the signal processing parameters of a known signal processing characteristic to create a new set of signal processing parameters.

It is preferred that the device have a plurality of channels, each of the channels having a different frequency band, and a cutoff frequency specifying a cutoff between at least two of the plurality of channels, and wherein at least some of the individual signal processing parameters of the set of signal processing parameters comprise the value of gain of at least one of the plurality of channels and the value of the cutoff frequency. It is preferred that the at least some of the acoustic parameters of the set of acoustic parameters further comprise the value of a release time for at least one of the plurality of channels. It is preferred that the value of the acoustic parameters of the vector and the corresponding one of the set of acoustic parameters of the auditory characteristic are combined according to a predetermined set of mathematical operations. It is preferred that the value of the individual one of the set of acoustic parameters of the vector is additive with the corresponding one of the set of acoustic parameters of the auditory characteristic. In one embodiment the value of each individual one of the set of acoustic parameters of the auditory characteristic is modified utilizing a value interpolated from the corresponding ones of the set of acoustic parameters from at least two of the vectors. In one embodiment a plurality of the vectors are utilized and a particular one of the plurality of vectors is determined based upon the desired auditory signal processing characteristic. In one embodiment at least some of the plurality of vectors are based upon the desired auditory signal processing characteristic and comprise a noise reduction vector and an intelligibility vector. More than one of the plurality of vectors may be utilized at a single time. In one embodiment the value of relative change for each individual acoustic parameter is determined by examining all of the plurality of vectors which are being utilized and selecting and utilizing only the value of the relative change in the acoustic parameter from among the plurality of vectors which has the greatest absolute magnitude.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

U.S. Pat. No. 4,425,481, Mangold et al, Programmable Signal Processing Device, is an example of a programmable signal processing device which may be utilized in a hearing improvement device, auditory prosthesis or hearing aid and with which the present inventions finds utility. The description in the Mangold et al patent discussed above is hereby incorporated by reference. The programmable signal processing device of Mangold et al consists mainly of a signal processor, a microphone supplying a signal to the signal processor and an earphone connected to the output of the signal processor which provides the output of the signal processing device. A memory is connected to the signal processor for storing certain acoustic parameters by which the signal processor determines the appropriate characteristics, which in the instance of a hearing aid are auditory characteristics, to be utilized by the signal processor. A control unit is coupled between the memory and the signal processor for selecting one of a plurality of sets of acoustic parameters to be supplied to the signal processing device and by which or through which the memories may be loaded with new acoustic parameter values. Thus, the signal processing device described in Mangold et al discloses a signal processing device which may be advantageously utilized in a hearing improvement device, auditory prosthesis or hearing aid. The description in Mangold et al, however, does not describe how the individual acoustic parameters which can be stored in the memory of the Mangold et al device are to be determined.

Figure 1:
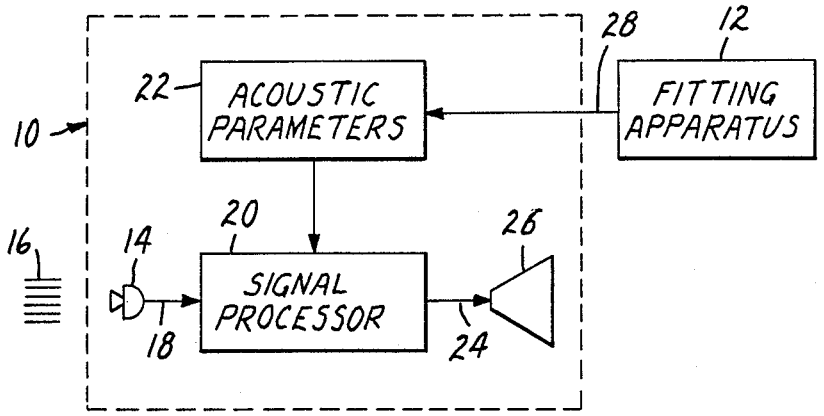
FIG. 1 is a block diagram of an auditory prosthesis, hearing aid or other hearing improvement device coupled to a fitting apparatus.

FIG. 1 illustrates an auditory prosthesis 10, or hearing improvement device or hearing aid, which may be externally connected to a fitting apparatus 12. As in Mangold et al, auditory prosthesis 10 contains a microphone 14 for receiving an acoustic signal 16 and transforming that acoustic signal 16 into an electrical input signal 18 which is supplied to a signal processor 20 which may be a two channel signal processor. Signal processor 20 then operates on the electrical input signal 18 according to a set of acoustic parameters 22 designed to compensate for a hearing impairment and producing a processed electrical signal 24. The processed electrical signal 24 is supplied to a receiver 26 which in hearing aid parlance is a miniature speaker to produce a signal perceptible to the user as sound. While this description is generally discussed in terms of hearing aids, it is to be recognized and understood that the present invention finds utility with other forms of auditory prostheses such as cochlear implants, in which case the receiver 24 would be replaced by an electrode or electrodes, an implanted hearing aid, in which the receiver 24 would be replaced with an electrical to mechanical transducer or tactile hearing aids, in which case the receiver would be replaced by a vibrotactile transducer.

In order to provide an individual, or user, with an auditory prosthesis 10 with appropriate auditory characteristic, as specified by the acoustic parameters 22, the auditory prosthesis 10 must be "fit" to the individual's hearing impairment. The fitting process involves measuring the auditory characteristics of the individual's hearing, calculating the nature of the amplification or other signal processing characteristics needed to compensate for a particular hearing impairment, determining the individual acoustic parameters which are to be utilized by the auditory prosthesis, and verifying that these acoustic parameters do operate in conjunction with the individual's hearing to obtain the amelioration desired. With the programmable auditory prosthesis 10 as illustrated in FIG. 1, the adjustment of acoustic parameters 22 occurs by electronic control of the auditory prosthesis from the fitting apparatus 12 which communicates with the auditory prosthesis 10 along communications link 28. Usually fitting apparatus 12 is a host computer which may be programmed to provide an initial "fitting", i.e., determine the initial values for acoustic parameters 22 in order to compensate for a particular hearing impairment for a particular individual with which the auditory prosthesis 10 is intended to be utilized. Such an initial "fitting" process is well known in the art. Examples of techniques which can be utilized for such an initial fitting may be obtained by following the technique described in Skinner, Margaret W., *Hearing Aid Evaluation,* Prentice Hall, Englewood Cliffs, N.J. (1988), the entire content of which is hereby incorporated by reference, especially Chapters 6–9. Similar techniques can be found in Briskey, Robert J., "Instrument Fitting Techniques", in Sandlin, Robert E., Hearing Instrument Science and Fitting Practices, National Institute for Hearing Instruments Studies, Livonia, Mich. (1985), pp. 439–494, which are hereby incorporated by reference. The DPS (Digital Programming System) which uses the SPI (Speech Programming Interface) programmer, available from Cochlear Corporation, Boulder Colo. is exemplary of a fitting system such as fitting system 12. This system is designed to work with WSP (Wearable Speech Processor), also available from Cochlear Corporation.

Figure 2:
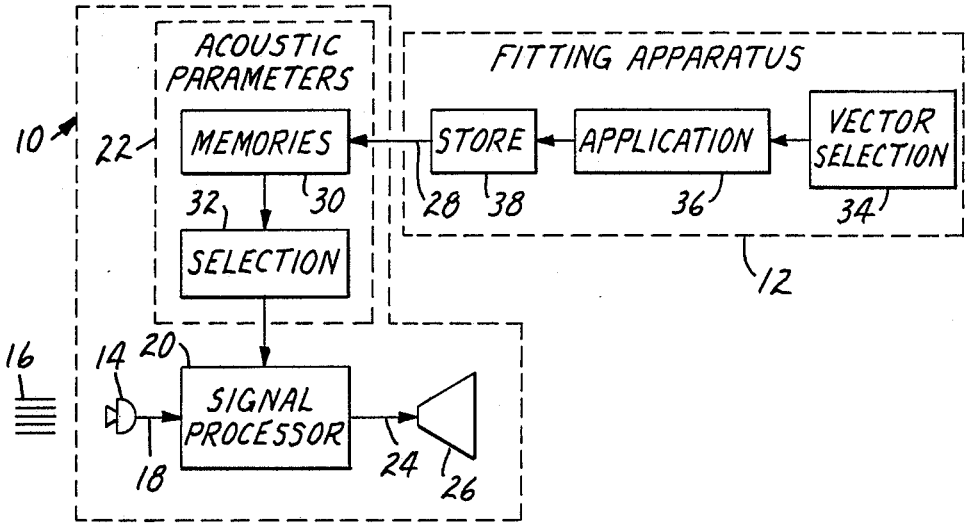
FIG. 2 is a block diagram of an auditory prosthesis, hearing aid or other hearing improvement device having multiple memories for acoustic parameters and illustrating the fitting apparatus in more detail.

FIG. 2 illustrates a block diagram of a preferred embodiment of the auditory prosthesis 10 operating in conjunction with the fitting apparatus 12. As in FIG. 1, the auditory prosthesis 10 receives an acoustic signal 16 by microphone 14 which sends an electrical input signal 18 to a signal processor 20. The signal processor 20 processes the electrical input signal 18 in conjunction with a set of acoustic parameters 22 and produces a processed electrical signal 24 which is sent to a receiver 26. Acoustic parameters 22 are illustrated as consisting of a plurality of memories 30, each of which contain a set of acoustic parameters which specify an auditory characteristic to which the auditory prosthesis 10 is designed to operate. A selection unit 32 operates to select one of the sets of acoustic parameters from memories 30 and supplies that selected set to the signal processor 20. Fitting apparatus 12, in the context of the present invention, is connected with the memories 30 by communication link 28. The fitting apparatus 12 consists of a vector selection mechanism 34, to be described later, a vector application mechanism 36, also to be described later, and a storage mechanism 38 receiving the output of the vector application mechanism 36 for supplying the new values of the acoustic parameters 22 via communication link 28 to memories 30 within the auditory prosthesis 10.

Known mechanisms of determining the values for the acoustic parameters in order to determine the auditory characteristics of an auditory prosthesis usually involve measuring the hearing impairment of the individual and determining the value of acoustic parameters necessary in order to compensate for the hearing impairment so measured. These known mechanisms operate well to determine ab initio the values of the acoustic parameters to be initially supplied to the auditory prosthesis 10. However, during fitting it is commonly advisable to change or modify the supplied auditory characteristics and, in particular, to modify the known or existing auditory characteristic toward a particular auditory goal such as decreasing the response of the auditory prosthesis to extraneous noise or increasing the intelligibility which the user will achieve using the auditory prosthesis 10. The auditory prosthesis 10 and the fitting apparatus 12 of the present invention operate to solve this problem by providing a fitting adjustment mechanism which utilizes a vector concept to provide relative changes in the auditory characteristic of the auditory prosthesis 10 by providing relative changes to a plurality of individual ones of the set of acoustic parameters 22 which specify that auditory characteristic. Instead of modifying the acoustic parameters 22 individually or instead of redetermining the acoustic parameters 22 ab initio, the vector concept of the present invention operates by selecting a vector which specifies relative changes to a plurality of acoustic parameters 22 on an entire set basis. Since relative changes are provided to the settings or values of the acoustic parameters 22, a relative change in the auditory characteristics of the auditory prosthesis 10 may be obtained.

Figure 3:
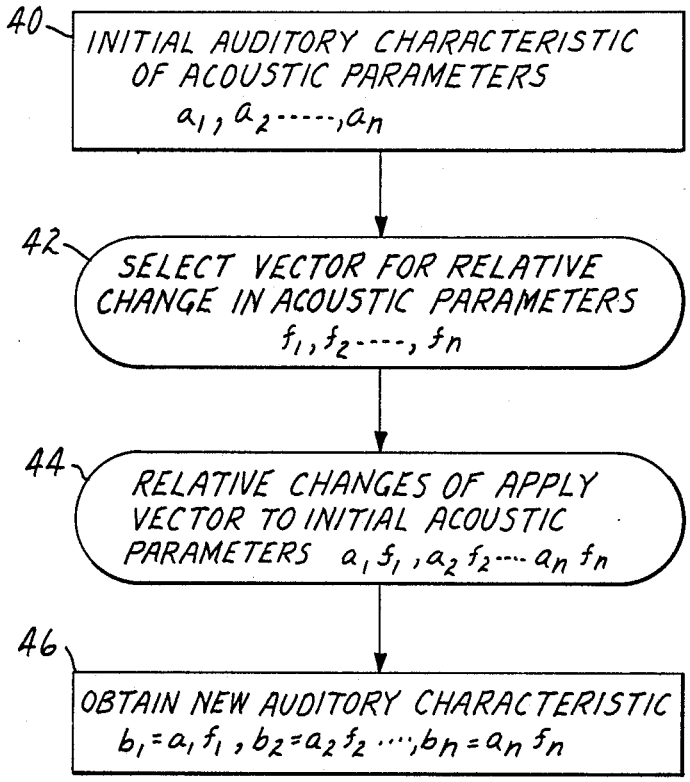
FIG. 3 is a flow diagram of the method steps contemplated in carrying out the present invention.

The vector process for modifying the auditory characteristics of the auditory prosthesis 10 is illustrated in FIG. 3. In FIG. 3, in step 40, the initial auditory characteristic of the auditory prosthesis 10 is determined, or has been determined, by selecting values of acoustic parameters $A_1, A_2 \ldots, A_n$. Once a change or modification in the goal of the auditory characteristic of the auditory prosthesis 10 is identified, step 42 selects a vector consisting of a relative change in individual ones of the acoustic parameters 22 as illustrated in step 42 and defined by $F_1, F_2 \ldots, F_n$. Then, in step 44, these relative changes of the vector are applied to the initial acoustic parameters determined in step 40 to obtain in step 46 a new set of auditory characteristics based on the original acoustic parameters $A_1, A_2 \ldots, A_n$ by applying a function to the individual ones consisting of $F_1, F_2 \ldots, F_n$ and obtaining the new result, namely, $B_1=F_1(A_1), B_2=F_2(A_2) \ldots, B_n=F_n(A_n)$.

Changes in the auditory characteristics of the auditory prosthesis 10 known in the prior art usually involve revising the settings or values of individual acoustic parameters 22. Since many of these individual acoustic parameters interact with each other, changing one may, in fact, necessitate the modification of another of the acoustic parameters. The present invention operates by a coordinated adjustment of more than one of the acoustic parameters simultaneously. It is preferred that the entire set of acoustic parameters be altered. In this way, the auditory goal of an adjustment may be defined and applied to the auditory prosthesis 10, and result in appropriately altered values for more than one, and preferably the entire set, of acoustic parameters 22 to result in an auditory characteristic which achieves the auditory goal desired.

The following discussion provides an example of the vector concept of the present invention in operation, and is shown in Table I.

TABLE I

| | ACOUSTIC PARAMETERS | | | | |
|---|---|---|---|---|---|
| | Low Pass Gain | Low Pass Attack | High Gain | High Pass Attack | Cutoff Frequency |
| INITIAL AUDITORY CHARACTERISTIC | 30 dB | 10 ms | 40 dB | 20 ms | 2000 Hz |
| VECTOR | −5 dB | −10 ms | 0 dB | 0 ms | −500 Hz |
| NEW AUDITORY CHARACTERISTIC | 25 dB | 0 ms | 40 dB | 20 ms | 1500 Hz |

Assume that a given auditory prosthesis, in this case a hearing aid, has a set of acoustic parameters to specify the auditory characteristic of a two channel hearing aid. Assume that the individual acoustic parameters are defined by a low pass gain, low pass attack time, high pass gain, high pass attack time and low pass-high pass cutoff frequency. Also assume that known mechanisms have been employed to determine an initial valuation for the acoustic parameters for this hearing aid of a low pass gain of 30 dB, a low pass attack time of 10 milliseconds, a high pass gain of 40 dB, a high pass attack time of 20 milliseconds and a low pass-high pass cutoff frequency of 2000 Hertz. Given this auditory characteristic specified by these acoustic parameters, and given that it is desired to modify the auditory characteristic so that the auditory characteristic of this hearing aid is less susceptible to a noisy environment then a "noise reduction" vector may be applied which contains a set of relative changes for these individual acoustic parameters. A typical noise reduction vector may consist of acoustic parameters in which the low pass gain is lowered by 5 dB, the low pass attack time is shortened by 10 milliseconds, the high pass gain is not modified, the high pass attack time is not modified and the low pass-high pass cutoff frequency is lowered by 500 Hertz. Applying this "noise reduction" vector to the initial acoustic parameters results in a low pass gain of 25 dB, a low pass attack time of 0 milliseconds, an unchanged high pass gain of 40 dB, an unchanged high pass attack time of 20 milliseconds and a low pass-high pass cutoff frequency of 1500 Hertz. This processing is illustrated in Table 1. Thus, a "noise reduction" vector has been applied that might be appropriate to reduce the susceptibility of the auditory characteristic of the hearing aid to extraneous noise of low frequency impulsive type. In other words, if the initial setting of the hearing aid was satisfactory for the user except that it was felt to be difficult to use in a noisy situation, the "noise reduction" vector as described above could be applied to produce the new setting which has less gain in a more reduced low pass frequency region and a more rapid automatic gain control attack time. The noise reduction vector, thus, operates to decrease the amplification of low frequency sounds which is the major contributor to noise in most environments and to ensure that the automatic gain control circuitry rapidly responds to those noise components which do get through the low pass channel.

While the above "noise reduction" vector has been described in terms of a mathematical addition to the previously obtained acoustic parameters, it is noted that these vectors may have two potential types of elements, relative and absolute. Relative elements specify the change from the initial value to the new value by a mathematical process, such as addition. Absolute elements may specify the value of a particular acoustic parameter independent of its original value among the initial settings. Both types may be mixed together depending upon the particular desired auditory characteristic to be obtained.

It should be noted that more than one vector may be combined to form a new or composite vector or combined to provide a new or composite result which results in a new auditory characteristic which has an auditory characteristic which is a composite of both vectors. In the case where a multiple combination of vectors is applied, it may be desirable to form different rules other than simply adding the relative change of one vector and then adding the relative change of the second vector. For example, if an "intelligibility" vector is applied along with an "impulsive sound" vector, both vectors may increase the release time of the automatic gain control circuitry. When both vectors are utilized, however, the appropriate alteration of the initial acoustic parameters is not the sequential addition of the relative changes of both vectors to modify the characteristic. Rather the appropriate alteration is to look at the maximum value of change of individual acoustic parameters of both vectors and apply the relative change of that acoustic parameter selected from both vectors which provides the maximum change to the original acoustic parameter.

For auditory prostheses which contain memory for more than one set of acoustic parameters at a given time, it is contemplated that the auditory prosthesis may itself operate as the fitting apparatus 12 to create additional sets of acoustic parameters which specify differing auditory characteristics according to predetermined goals which are then stored within the memory of the auditory prosthesis. Thus the auditory prosthesis once provided with initial set of acoustic parameters, may bootstrap another set of acoustic parameters or another entire memory full of sets of acoustic parameters utilizing vectors, all of which are individually adjusted to the individual hearing impairment of the user.

The following table gives an example of the vector concept at work with a hearing aid which contains a different set of acoustic parameters from that discussed above.

TABLE II

| Field Label | Units | Input Program | Modif. Vector | Output Program |
|---|---|---|---|---|
| Input Protection Level | dB | 10 | +2 | 12 |
| Crossover Frequency | Hz | 1021 | 0 | 1021 |
| Low Pass Maximum Power Out | dB SPL | 90 | +10 | 100 |
| Low Pass Automatic Gain Control Threshold | dB SPL | 94 | −8 | 86 |
| Low Pass Automatic Gain Control Release time | ms | Norm | −1 | Short |
| High Pass Maximum Power Out | dB SPL | 110 | +5 | 115 |
| High Pass Automatic Gain Control Threshold | dB SPL | 87 | +3 | 90 |
| High Pass Automatic Gain Control Release Time | ms | Long | +1 | Long |

The table illustrates the initial set of acoustic parameters, the acoustic parameters of the vector which operates to modify that set of acoustic parameters and the modified set of acoustic parameters which represent the modified auditory characteristic of the hearing aid. In this situation, the modification vector may be applied more than once depending upon the degree of change of the desired auditory characteristic. That is, the relative changes specified in this particular vector may be applied a number of times, e.g., twice to result in double the modification toward the particular auditory goal desired than which would otherwise result from a single application.

Figure 4:
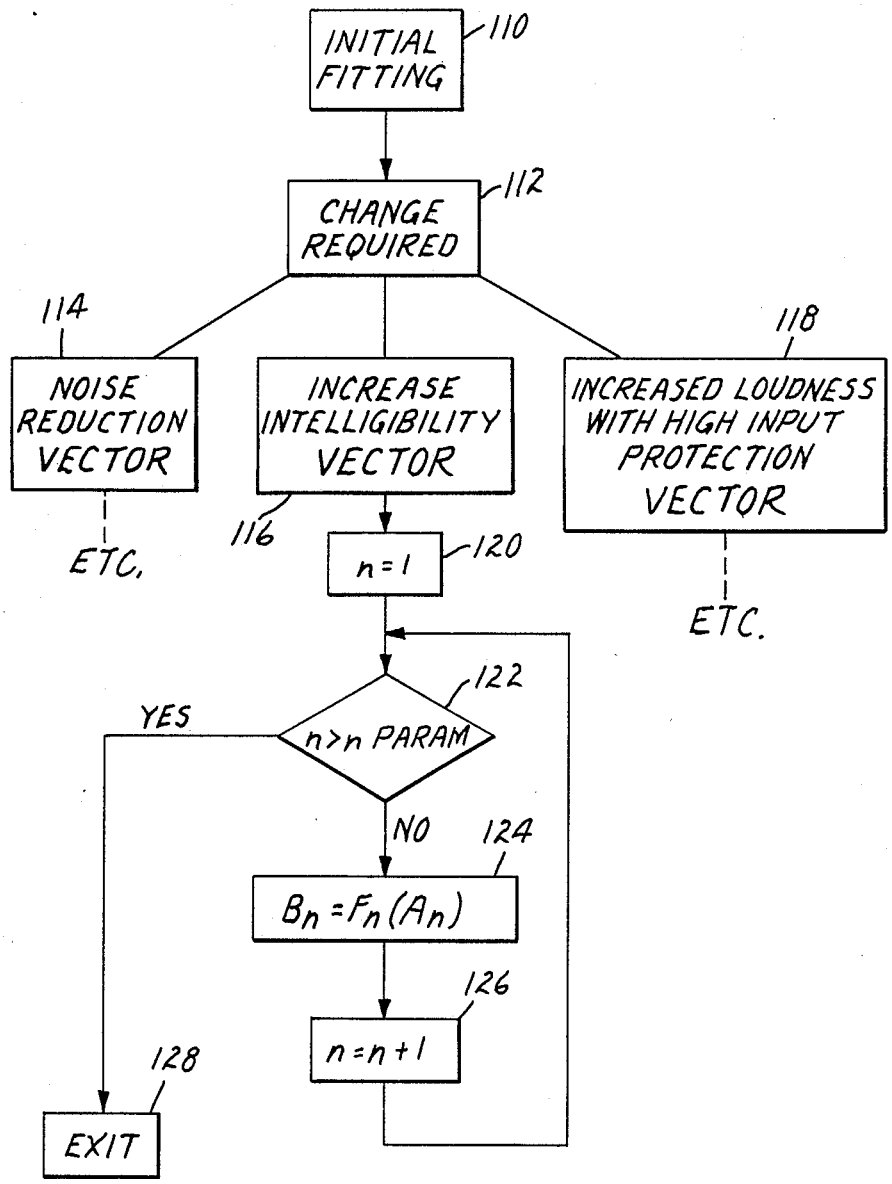
FIG. 4 is a flow diagram illustrating a series of steps to carry out the application of a vector to an initial auditory characteristic.

A flow chart illustrating the application of a selected vector, in this case an "intelligibility" vector, is illustrated in FIG. 4. The initial fitting, i.e., the initial determination of the acoustic parameters, is presumed and, as discussed above, is well known in the art. The process at step 112 determines the change required, or desired, from some objective or subjective technique determined by the user or by the fitter. This is analogous to selecting the particular vector to be utilized. Either the "noise reduction" vector can be applied, step 114, the "intelligibility" vector can be applied, step 116, or the "increased loudness with high input protection" vector, step 118, can be applied. For purposes of illustration only the series of steps following the "intelligibility" vector are shown. It is to be recognized that a similar series of steps also follow step 114 ("noise reduction") and step 118 ("increased loudness with high input protection"). Following the decision to apply the "intelligibility" vector (step 116), the process at step 120 sets the value of $n=1$ and then determines if the value of n is greater than the number of acoustic parameters in this vector (step 122). If not, the process applies the first acoustic parameter of the vector (step 124) in the normal fashion as discussed above. The value of n is then incremented (step 126) and the process returned to step 122. The next acoustic parameter is then altered through step 124 until step 122 determines that the value of n exceeds the number of acoustic parameters of the vector indicating that all acoustic parameters in the vector have been applied. The process then exits, or ends, at step 128.

While the above description refers to the relative change in acoustic parameters which involve a mathematical addition, it is to be recognized and understood, however, that other forms of mathematical operations with the values of the acoustic parameters may be performed and are within the scope of the present invention. For example, a multiplication, either on a linear basis or logarithmic basis, may be utilized in addition to or in combination with the additive process. Other mathematical operations are also possible. As shown in the functional notation in block 46 of FIG. 3, the operations performed by the vectors do not have to be standard mathematical functions but may generally be any functional relationship. It is only required that the vector be applied so that the resulting acoustic parameter is a function of the value for that acoustic parameter contained in the vector. As one example, the vector may specify that degree of change in the crossover frequency between the low pass and the high pass frequency bands. Since it is impractical to change the crossover frequency in one Hertz increments, the vector may specify the number of quantization steps to be changed, the quantization steps being variable, and in one example may be 150 Hertz quantization steps. Thus, the number 1 for this acoustic parameter in the vector would specify a 150 Hertz change in the value of the crossover frequency, a number 2 would specify a 300 Hertz change, etc.

Another way to utilize the relative vector concept of the present invention is to utilize two vectors which modify the auditory characteristic by making a relative change based upon a blend of an individual acoustic parameter from both vectors. This technique would avoid the use of successively applied vectors or largest magnitude change by interpolating between the individual acoustic parameters specified in both vectors. Thus, if one vector called for a 5 dB increase of a given acoustic parameter and the second vector called for a 10 dB increase of the same acoustic parameter, then by interpolating between the values of change of this acoustic parameter a modification to the existing acoustic parameter of 7.5 dB would be specified.

Figure 5:
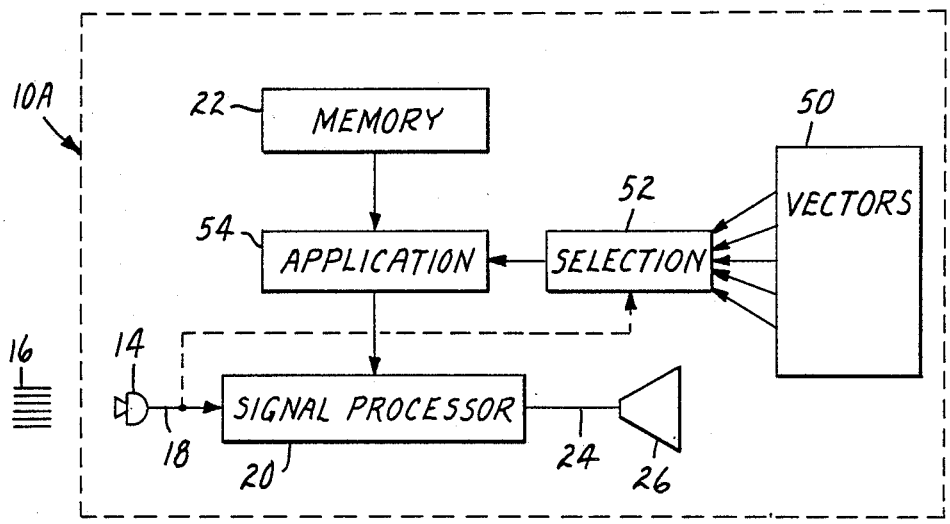
FIG. 5 is a block diagram of an alternative embodiment of the present invention.

Throughout the above description, the fitting apparatus 12 has been described as being separate from the auditory prosthesis 10. The auditory prosthesis 10A illustrated in FIG. 5 provides a different concept from the auditory prosthesis 10 of FIG. 1. The auditory prosthesis 10A has a microphone 14 for receiving an acoustic signal 16 and providing an electrical input signal 18 to a signal processor 20 which operates in accordance with a set of acoustic parameters 22 in this case stored in a memory. The processed electrical signal 24 from the signal processor 20 is supplied to a receiver 26 which provides a sound which is perceptible to the user. The auditory prosthesis 10A, illustrated in FIG. 5, however in contrast to that disclosed in Mangold et al, provides a memory which stores only a single set of acoustical parameters 22. The auditory prosthesis 10A does provide a memory 50 for storing at least one vector consisting of a relative change in the acoustic parameters 22. Preferably, it is envisioned that memory 50 would store a plurality of vectors. One of these vectors would then be selected by selection mechanism 52 and applied, as discussed above, by application mechanism 54. Hence, the modified set of acoustic parameters would be supplied to the signal processor 20. This would provide a readily obtainable modification to the auditory characteristic of the auditory prosthesis 10A. In the less preferred situation where only a single vector is stored in memory 50, the selection mechanism 52 would operate to supply information to the application mechanism 54 in order to interpolate or adjust for varying degrees of the vector 50 which are to be applied to the acoustic parameters 22 in accordance with a particular desired change in the auditory characteristic of the auditory prosthesis 10A.

Figure 6:
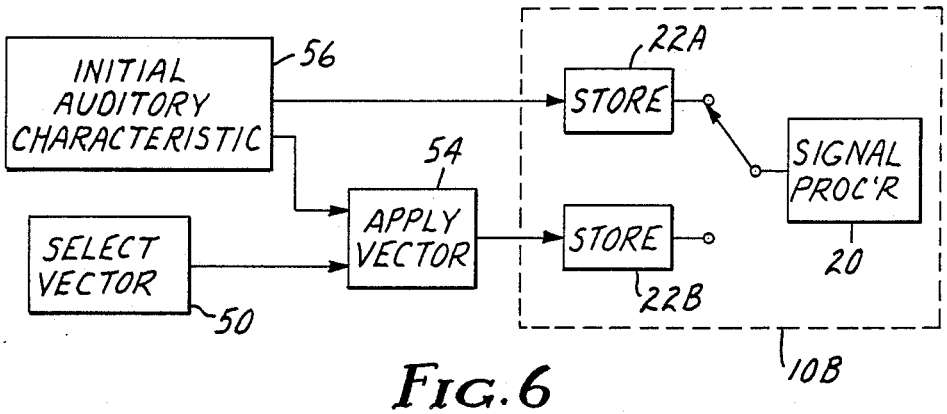
FIG. 6 is a block diagram of another alternative embodiment of the present invention.
Figure 7:
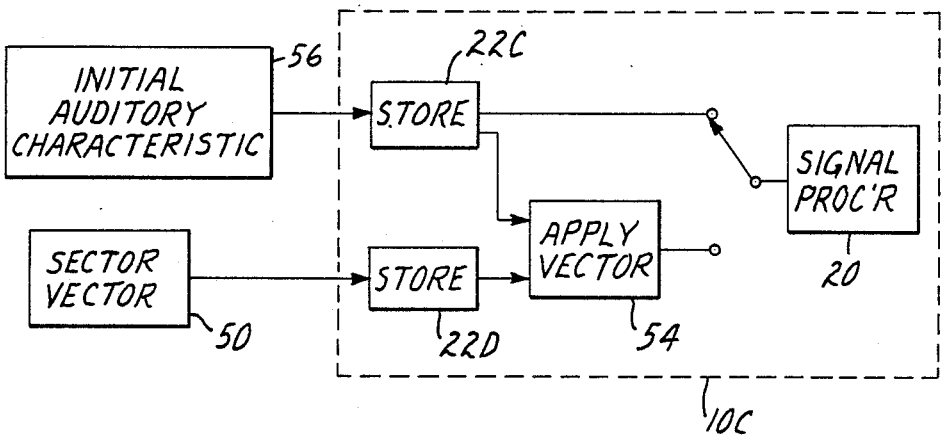
FIG. 7 is a block diagram of still another alternative embodiment of the present invention.

Alternative embodiments of the present invention are illustrated in FIGS. 6 and 7.

FIG. 6 shows a block diagram of an auditory prosthesis 10B in which the signal processor 20 is shown but the microphone 14 and the receiver 26 have been omitted for clarity. Signal processor 20 can select from either of two sets of acoustic parameters 22A and 22B. The values for the set of acoustic parameters 22A is obtained from the values of the initial fitting criteria 56 which were initially obtained by the fitting system and separate from the auditory prosthesis 10B. The values for the set of acoustic parameters 22B can be obtained from application mechanism 54 which applies the values for the vector from vector storage 50 to the values of the initial fitting criteria 56. In the embodiment both sets of acoustic parameters 22A and 22B are contained within the auditory prosthesis 10B while the application mechanism 54, the initial fitting criteria 56 and the vector storage 50 are located outside of the auditory prosthesis 10B.

FIG. 7 shows a block diagram of an auditory prosthesis 10C again in which the signal processor 20 is shown but the microphone 14 and the receiver 26 have been omitted for clarity. The signal processor 20 can select from either the set of acoustic parameters 22C which are obtained from the initial fitting criteria 56 or from application mechanism 54. Application mechanism 54 applies the vector stored in the set of acoustic parameters 22D to the values from initial fitting criteria 56. The set of acoustic parameters are obtained from vector storage 50. In this embodiment the application mechanism 54 and the sets of acoustic parameters is contained in the auditory prosthesis 10C while the initial fitting criteria 56 and the vector storage 50 are located outside of the auditory prosthesis 10C.

An automatic selection or application of vectors is also contemplated in accordance with the present invention. In the auditory prosthesis 10A illustrated in FIG. 5, vectors are stored in memory 50 within the auditory prosthesis 10A. The user may then effect alterations in the prescription (auditory characteristics) depending upon his environment by operating a switch or remote control which modifies selection mechanism 52. The automatic application of differing vectors depends on recognizing some characteristic of the sound incident on the microphone 14 of the auditory prosthesis 10A and selecting via selection mechanism 52 the vector to be applied via application mechanism 54 based on the degree to which this characteristic is present, or not to modify it all. Suppose that one of the vectors available is a "noise reduction" vector designed to improve the performance of the auditory prosthesis 10A in a noisy environment. The auditory prosthesis 10A could detect whether the electrical input signal 18 indicated the presence of noise and when was detected would cause the "noise reduction" vector to be applied. In this situation, electrical input signal 18 would also be supplied as in input to selection mechanism 52 as shown by the dotted line in FIG. 5.

The concept of automatic selection of a particular vector could also be applied to the auditory prosthesis 10 of FIG. 1 in which a plurality of sets of acoustic parameters are contained within the auditory prosthesis 10.

Thus, it can be seen that there has been shown and described a novel method of determining new auditory characteristics for a hearing improvement device, auditory prosthesis, hearing aid and a novel hearing aid and novel apparatus for determining the acoustic parameters for an auditory prosthesis. It is to be recognized and understood, however, that various changes, modifications and substitutions in the form and the details of the present invention may be made by those skilled in the art without departing from the scope of the invention as defined by the following claims.

What is claimed is:

1. For use with a hearing improvement device having a storage means for storing a set of signal processing parameters corresponding to a known signal processing characteristic, and a signal processor to process a signal representing sound in accordance with said set of signal processing parameters with at least one of said signal processing parameters designed to compensate for a hearing impairment, a method of determining a new set of said signal processing parameters in accordance with a desired change in the auditory characteristics of said hearing improvement device, comprising the steps of:

selecting a vector consisting of changes in the values of individual signal processing parameters in accordance with predetermined signal processing characteristics related to said desired change in the auditory characteristics of said hearing improvement device; and applying said changes in the values of said individual signal processing parameters of said vector against the values of corresponding ones of the individual signal processing parameters of said set of signal processing characteristics to create a new set of signal processing parameters.

2. A method as in claim 1 wherein said hearing improvement device has a plurality of channels, each of said channels having a different frequency band, and a crossover frequency specifying a crossover between at least two of said plurality of channels, and wherein at least some of said individual signal processing parameters of said set of signal processing parameters comprise the value of gain of at least one of said plurality of channels and the value of said crossover frequency.

3. A method as in claim 2 wherein said at least some of said signal processing parameters of said set of signal processing parameters further comprise the value of a release time for at least one of said plurality of channels.

4. A method as in claim 1 wherein the value of said auditory parameters of said vector and the corresponding one of said set of signal processing parameters of said auditory characteristic are combined according to a predetermined set of mathematical operations.

5. A method as in claim 4 wherein the value of said individual one of said set of signal processing parameters of said vector is additive with the corresponding one of said set of signal processing parameters of said auditory characteristic.

6. A method as in claim 4 wherein the value of each individual one of said set of signal processing parameters of said auditory characteristic is modified utilizing a value interpolated from the corresponding ones of said set of signal processing parameters from at least two of said vectors.

7. A method as in claim 4 wherein a plurality of said vectors are utilized and wherein a particular one of said plurality of vectors is determined based upon said desired auditory signal processing characteristic.

8. A method as in claim 7 wherein at least some of said plurality of vectors are based upon said desired auditory signal processing characteristic and comprise a noise reduction vector and an intelligibility vector.

9. A method as in claim 7 wherein more than one of said plurality of vectors is utilized at a single time.

10. A method as in claim 9 wherein the value of relative change for each individual auditory parameter is determined by examining all of said plurality of vectors which are being utilized and selecting and utilizing only the value of the auditory parameter from among said plurality of vectors which has the greatest absolute magnitude.

11. For use with an auditory prosthesis having a plurality of memories, each of said plurality of memories for soring a set of signal processing parameters, at least one of said signal processing parameters designed to compensate for a hearing deficiency, each of said set of signal processing parameters corresponding to a known signal processing characteristic, a signal processor to process a signal representing sound in accordance with a selected one of said plurality of sets of signal processing parameters, and selection means coupled to said plurality of memories and to said signal processor for selecting one of said plurality of memories to determine which set of signal processing parameters is utilized by said signal processor, a method of determining the values of a new set of signal processing parameters in accordance with a desired change in the auditory characteristics of said auditory prosthesis, comprising the steps of:

selecting a vector consisting of relative changes in the values of individual signal processing parameters in accordance with predetermined signal processing characteristics related to said desired change in the auditory characteristics of said auditory prosthesis;

applying said relative changes in the values of said individual signal processing parameters of said vector against the values of corresponding ones of said signal processing parameters of a known signal processing characteristic to create a new signal processing characteristic; and utilizing said new signal processing characteristic in said signal processor of said auditory prosthesis.

12. A method as in claim 11 wherein said auditory prosthesis has a plurality of channels, and a crossover frequency specifying a crossover between at least two of said plurality of channels, and wherein at least some of said individual signal processing parameters of said set of signal processing parameters comprise the value of gain of at least one of said plurality of channels and the value of said crossover frequency.

13. A method as in claim 12 wherein said at least some of said signal processing parameters of said set of signal processing parameters further comprise the value of a release time for at least one of said plurality of channels.

14. A method as in claim 11 wherein the value of one of said set of signal processing parameters of said vector and the corresponding one of said set of signal processing parameters of said selected one of said plurality of signal processing characteristics are combined according to a predetermined set of mathematical operations.

15. A method as in claim 14 wherein the value of one of said set of signal processing parameters of said vector is additive with the corresponding one of said set of signal processing parameters of said selected of one of said plurality of signal processing characteristics.

16. A method as in claim 14 wherein the value of each individual one of said set of signal processing parameters of said auditory characteristic is modified utilizing a value interpolated from corresponding ones of said set of signal processing parameters from at least two of said vectors.

17. A method as in claim 14 wherein a plurality of said vectors are utilized and wherein a particular one of said plurality of vectors is determined based upon a particular signal processing goal.

18. A method as in claim 17 wherein at least some of said plurality of vectors are based upon a signal processor goal and comprise a noise reduction vector and an intelligibility vector.

19. A method as in claim 17 wherein more than one of said plurality of vectors is utilized at a single time.

20. A method as in claim 19 wherein the value of relative change for each individual one of said set of signal processing parameters is determined by examining all of said plurality of vectors which are being utilized and selecting and utilizing only the value of one of the sets of signal processing parameters from among said plurality of vectors which has the greatest absolute magnitude.

21. For use with a hearing improvement device having a plurality of memories, each of said plurality of memories for storing a signal processing characteristic specifying a plurality of signal processing parameters at least one of which is designed to compensate for a hearing impairment, a signal processor to process a signal representing sound in accordance with a selected signal processing characteristic, and memory selection means coupled to said plurality of memories and to said signal processor for selecting one of said plurality of memories to determine which signal processing characteristic is utilized by said signal processor, an apparatus for determining the values of said signal processing parameters for a particular signal processing characteristic from the values of said signal processing parameters of a known signal processing characteristic, comprising:

vector selection means for selecting a vector consisting of changes in the values of individual signal processing parameters in accordance with predetermined signal processing characteristics;

application means coupled to said vector selection means for applying said changes in the values of said individual signal processing parameters of said vector against the values of the signal processing parameters of a known signal processing characteristic to create a new signal processing characteristic; and storing means coupled to said application means for storing said new signal processing characteristic in one of said plurality of memories.

22. An apparatus as in claim 21 wherein said hearing improvement device has a plurality of channels, each of said channels having a different frequency band, and a crossover frequency specifying a crossover between at least two of said plurality of channels, and wherein at least some of said individual signal processing parameters of said set of signal processing parameters comprise the value of gain of at least one of said plurality of channels and the value of said crossover frequency.

23. An apparatus as in claim 22 wherein said at least some of said signal processing parameters of said set of signal processing parameters further comprise the value of a release time for at least one of said plurality of channels.

24. An apparatus as in claim 21 wherein the value of said signal processing parameters of said vector and the corresponding one of said set of signal processing parameters of said signal processing characteristic are combined by said application means according to a predetermined set of mathematical operations which specifies a relative change.

25. An apparatus as in claim 24 wherein the value of said individual one of said set of signal processing parameters of said vector is additive in said application means with the corresponding one of said set of signal processing parameters of said signal processing characteristic.

26. An apparatus as in claim 24 wherein the value of each individual one of said set of signal processing parameters of said signal processing characteristic is modified by said application means utilizing a value interpolated from the corresponding ones of said set of signal processing parameters from at least two of said vectors.

27. An apparatus as in claim 24 wherein a plurality of said vectors are utilized and wherein said selection means selects a particular one of said plurality of vectors based upon said desired signal processing signal processing characteristic.

28. An apparatus as in claim 27 wherein at least some of said plurality of vectors are based upon said desired signal processing signal processing characteristic and comprise a noise reduction vector and an intelligibility vector.

29. An apparatus as in claim 27 wherein more than one of said plurality of vectors is utilized at a single time.

30. An apparatus as in claim 29 wherein the value of relative change for each individual signal processing parameter is determined by said application means by examining all of said plurality of vectors which are being utilized and selecting and utilizing only the value of the signal processing parameter from among said plurality of vectors which has the greatest absolute magnitude.

31. A hearing aid, comprising:

a microphone for converting acoustic information into an electrical input signal;

a signal processor receiving said electrical input signal and operating on said electrical input signal in response to a set of signal processing parameters at least one of which is designed to compensate for a hearing impairment and producing a processed electrical signal;

a receiver coupled to said signal processor for converting said processed electrical signal to a signal adapted to be perceptible to a patient;

first storage means operably coupled to said signal processor for storing at least one of said set of signal processing parameters;

vector means for storing a vector consisting of relative changes in the values of individual signal processing parameters in accordance with predetermined signal processing characteristics; and application means operably coupled to said first storage means and said vector means for applying said relative changes in the values of said individual signal processing parameters of said vector against the values of the signal processing parameters of a known signal processing characteristic to create a new set of signal processing parameters.

32. A hearing aid as in claim 31 which has a plurality of channels, each of said channels having a different frequency band, and a crossover frequency specifying a crossover between at least two of said plurality of channels, and wherein at least some of said individual signal processing parameters of said set of signal processing parameters comprise the value of gain of at least one of said plurality of channels and the value of said crossover frequency.

33. A hearing aid as in claim 32 wherein said at least some of said signal processing parameters of said set of signal processing parameters further comprise the value of a release time for at least one of said plurality of channels.

34. A hearing aid as in claim 31 wherein the value of said signal processing parameters of said vector and the corresponding one of said set of signal processing parameters of said signal processing characteristic are combined by said application means according to a predetermined set of mathematical operations.

35. A hearing aid as in claim 34 wherein the value of said individual one of said set of signal processing parameters of said vector is additive in said application means with the corresponding one of said set of signal processing parameters of said signal processing characteristic.

36. A hearing aid as in claim 34 wherein the value of each individual one of said set of signal processing parameters of said signal processing characteristic is modified by said application means utilizing a value interpolated from the corresponding ones of said set of signal processing parameters from at least two of said vectors.

37. A hearing aid as in claim 34 wherein a plurality of said vectors are utilized and which further comprises selection means for selecting a particular one of said plurality of vectors based upon said desired signal processing signal processing characteristic.

38. A hearing aid as in claim 37 wherein at least some of said plurality of vectors are based upon said desired signal processing signal processing characteristic and comprise a noise reduction vector and an intelligibility vector.

39. A hearing aid as in claim 37 wherein more than one of said plurality of vectors is utilized at a single time.

40. A hearing aid as in claim 39 wherein the value of relative change for each individual signal processing parameter is determined by said application means by examining all of said plurality of vectors which are being utilized and selecting and utilizing only the value of the signal processing parameter from among said plurality of vectors which has the greatest absolute magnitude.

* * * * *